US005251552A

United States Patent [19]

Gourdol

[11] Patent Number: 5,251,552

[45] Date of Patent: Oct. 12, 1993

[54] PRESS FOR HETEROGENEOUS WASTE

[76] Inventor: Jacques Gourdol, Notre-Dame de Lachal, 38760 Varces Allieres Risset, France

[21] Appl. No.: 896,996

[22] Filed: Jun. 11, 1992

[30] Foreign Application Priority Data

Jun. 11, 1991 [FR] France ..... 91 07087

[51] Int. Cl.[5] ..... B30B 9/06

[52] U.S. Cl. ..... 100/127; 100/218; 100/229 R; 100/244

[58] Field of Search ..... 100/112, 116, 126, 127, 100/130, 218, 229 R, 244

[56] References Cited

U.S. PATENT DOCUMENTS

| | | | |
|---|---|---|---|
| 214,838 | 4/1879 | O'Callaghan | 100/229 R |
| 230,449 | 7/1880 | Tyson | 100/229 R |
| 782,843 | 2/1905 | Geib | 100/229 RX |
| 1,696,474 | 12/1928 | Dutzmann | 100/126 X |
| 2,538,403 | 1/1951 | Watson | 100/127 X |
| 2,817,891 | 12/1957 | Zweigle | 100/244 X |
| 3,565,297 | 2/1971 | Bladt et al. | 100/218 X |
| 3,696,583 | 10/1972 | Tezuka | 100/218 X |
| 3,929,061 | 12/1975 | Banks et al. | 100/116 |
| 3,980,014 | 9/1976 | McEwen et al. | 100/127 |
| 4,184,614 | 1/1980 | Hurkmans | 100/218 X |
| 4,303,412 | 12/1981 | Baikoff | 100/127 X |
| 4,397,231 | 8/1983 | Burgin | 100/117 |
| 4,421,022 | 12/1983 | Burgin | 100/127 X |
| 4,993,315 | 2/1991 | Huber et al. | 100/116 X |

FOREIGN PATENT DOCUMENTS

| | | | |
|---|---|---|---|
| 897159 | 10/1983 | Belgium . | |
| 334777 | 3/1921 | Fed. Rep. of Germany . | |
| 337607 | 6/1921 | Fed. Rep. of Germany . | |
| 2577167 | 8/1986 | France | 100/126 |
| 2615443 | 11/1988 | France | 100/126 |
| 315807 | 10/1969 | Sweden | 100/127 |
| 743927 | 7/1980 | U.S.S.R. | 100/218 |
| 1542257 | 3/1979 | United Kingdom . | |

*Primary Examiner*—Stephen F. Gerrity

[57] ABSTRACT

The press comprises a frame (1), a feed zone (3) receiving the waste to be treated and a pressing chamber (9) formed by a die (11) with a cross-section equal to that of a compression piston (7). The die (11) is mounted in a slide (12) which is movable angularly between a first position placing the pressing chamber (9) in communication with the feed zone (3) and a second position placing the pressing chamber (9) in communication with a hatch (13) for discharge of the solid phase of the waste.

7 Claims, 4 Drawing Sheets

PRESS FOR HETEROGENEOUS WASTE

FIELD OF THE INVENTION

The invention relates to a press for heterogeneous waste.

BACKGROUND OF THE INVENTION

For several years, the increasing volume of waste and, in particular, domestic refuse, has made it necessary to seek solutions which enable this waste to be treated and exploited.

Consideration has already been given to using such waste as a fuel, but the presence therein of a high water content and of incombustible products only permits energy production at a level which is too low.

In fact, such waste consists of a liquid phase containing only organic products and a solid phase containing metal, inorganic and synthetic materials.

One solution consists in pressing this waste, which makes it possible to obtain residues which are sufficiently dry to form a fuel with an acceptable calorific value, and fluid substances which can be used, according to their nature, in agriculture as soil improvers or as raw materials from which chemical products may be extracted.

Devices are already known which permit this waste to be compressed, and these usually consist of hydraulic presses comprising a feed zone receiving the waste to be treated, and a pressing chamber connected to means for recovery of the liquid phase.

The pressing chamber comprises an entry orifice, an exit orifice and has a cross-section equal to that of a compression piston of a first ram.

The wall of the pressing chamber comprises a multitude of perforations emerging in a channel for discharge of the liquid phase extracted by -w compression of the waste.

The exit orifice of the pressing chamber is generally closed of f by a plug carried by a rod of a second ram opposite the first.

The pistons of the two rams are movable alternately between a first position of compression of the waste and of discharge of the liquid phase, during which the piston of the first ram penetrates into the pressing chamber and the piston of the second ram closes off the exit orifice of the chamber, and a second position of discharge of the solid phase, during which the piston of the first ram continues its travel and the piston of the second ram frees the exit orifice of the pressing chamber.

However, this type of press involves drawbacks.

In fact, taking into account the considerable stresses created at the time of pressing the waste, complete leaktightness is not achieved at the level of the exit orifice of the pressing chamber by the piston of the second ram, so that leakages of liquid may occur and penetrate into the chamber for discharge of the solid phase, thereby reducing the calorific value of the solid phase.

Moreover, the travel of the piston of the second ram is relatively great. This travel corresponds to a thickness of the solid phase, which involves a relatively long response time.

SUMMARY OF THE INVENTION

The present invention aims to avoid these drawbacks and to propose a press which is simple to produce, using conventional means, and which makes it possible to obtain both qualitative and quantitative high performance levels.

The subject of the present invention is thus a press for heterogeneous waste comprising a solid phase and a liquid phase, the press comprising:

a frame, a feed zone receiving the heterogeneous waste which is open towards the top and has two opposing lateral openings with a cross-section adapted to that of a compression piston which is movable between one of the openings of the feed zone and a position located beyond the other opening of the feed zone, a chamber for pressing the waste for the separation of the solid phase and the liquid phase, formed by a die with a cross-section equal to that of the compression piston and comprising calibrated passages connecting the pressing chamber to a collector for recovery of the liquid phase, and a hatch for discharge of the solid phase, characterised in that the die is mounted in a slide which is movable angularly between a first position placing the pressing chamber in communication with the feed zone and a second position placing the pressing chamber in communication with the hatch for discharge of the solid phase.

According to other characteristics of the invention:

the slide comprises a single orifice of entry into the pressing chamber of the waste to be pressed and of exit from the pressing chamber of the solid phase of the pressed waste, the slide is mounted in an articulated manner on the frame of the press by means of two opposing lateral shafts, each accommodated in a bearing integral with the frame, the slide is connected to means for controlling the angular displacement of the slide, the control means are formed by a ram whose body is mounted in an articulated manner on the frame of the press and the end of the rod of which is connected to the slide by a clevis-type articulation, the slide comprises means for discharge of the solid phase and means for discharge of the liquid phase, the means for discharge of the solid phase are formed by a ram arranged coaxially with the pressing chamber and integral with the slide, the rod of the ram traverses the slide and comprises at its free end a disc forming the back of the pressing chamber and with dimensions which complement the die, the means for discharge of the liquid phase are formed by at least one channel at the periphery of the die communicating with the calibrated passages of the die and the recovery collector located outside the slide.

BRIEF DESCRIPTION OF THE DRAWINGS

Further features and advantages of the invention will become apparent during the description which follows, made with reference to the appended drawings which are given solely by way of example and in which.

DESCRIPTION OF PREFERRED EMBODIMENT

Figure 1:
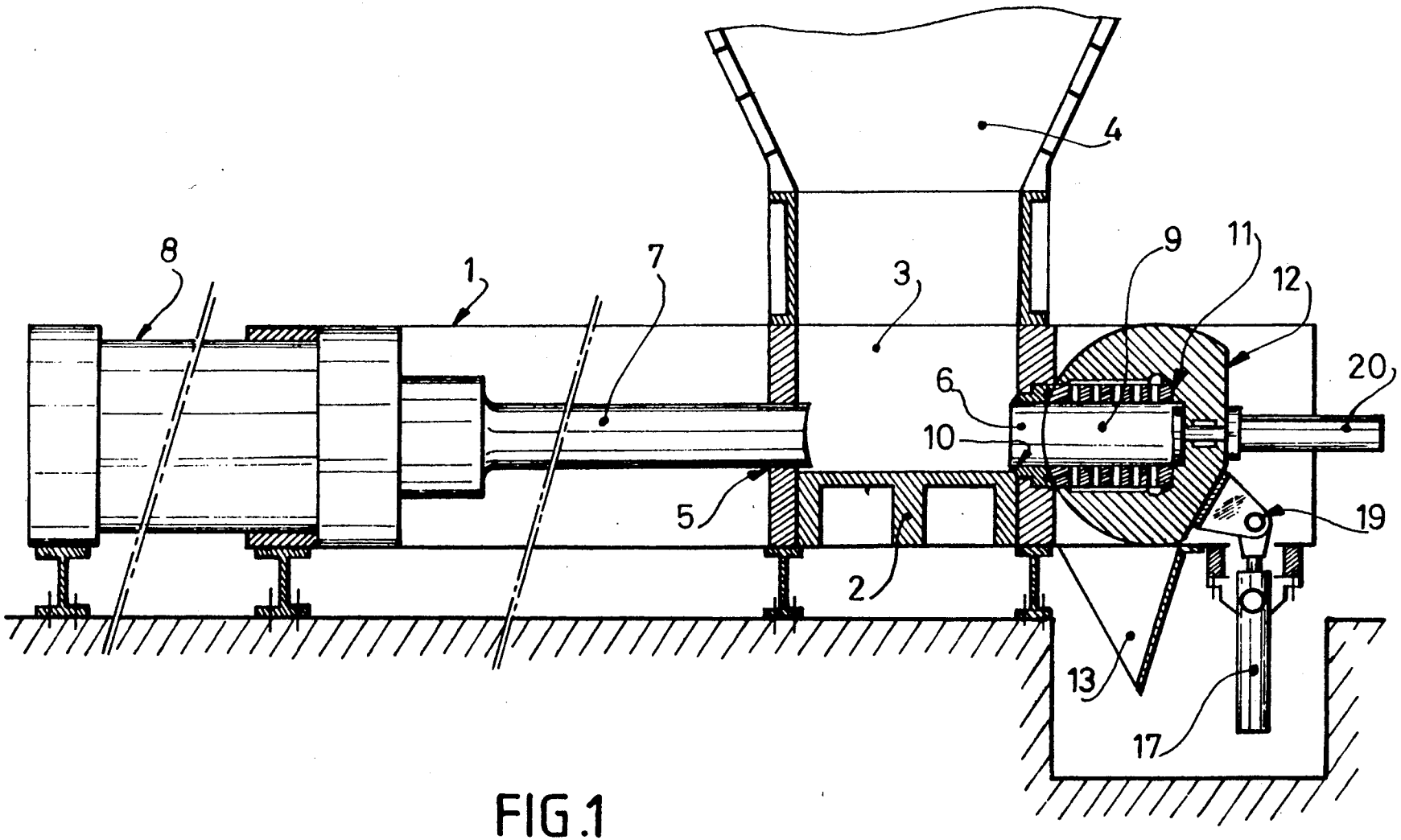
FIG. 1 is a schematic view in longitudinal section of a press produced according to the invention.

The press shown in FIG. 1 comprises a frame 1 supporting a receptacle 2 forming a feed zone 3 for heterogeneous waste.

To this end, the feed zone 3 is open toward the top and surmounted by a hopper 4 equipped with at least one rammer (not shown), permitting introduction of the waste into the feed zone 3.

This feed zone 3 has two opposing lateral openings 5 and 6 with a cross-section adapted to that of a compression piston 7 of a ram 8, for example a hydraulic ram supporting the frame 1.

The piston 7 is movable under the action of ram 8 between the opening 5 and a position located beyond the other opening 6 of the feed zone 3.

The opening 6 of the feed zone 3 emerges in a pressing chamber 9 coaxial therewith.

The opening 6 is provided with a ring 10 whose face oriented towards the pressing chamber 9 is in the form of a portion of a cylinder.

Figure 2:
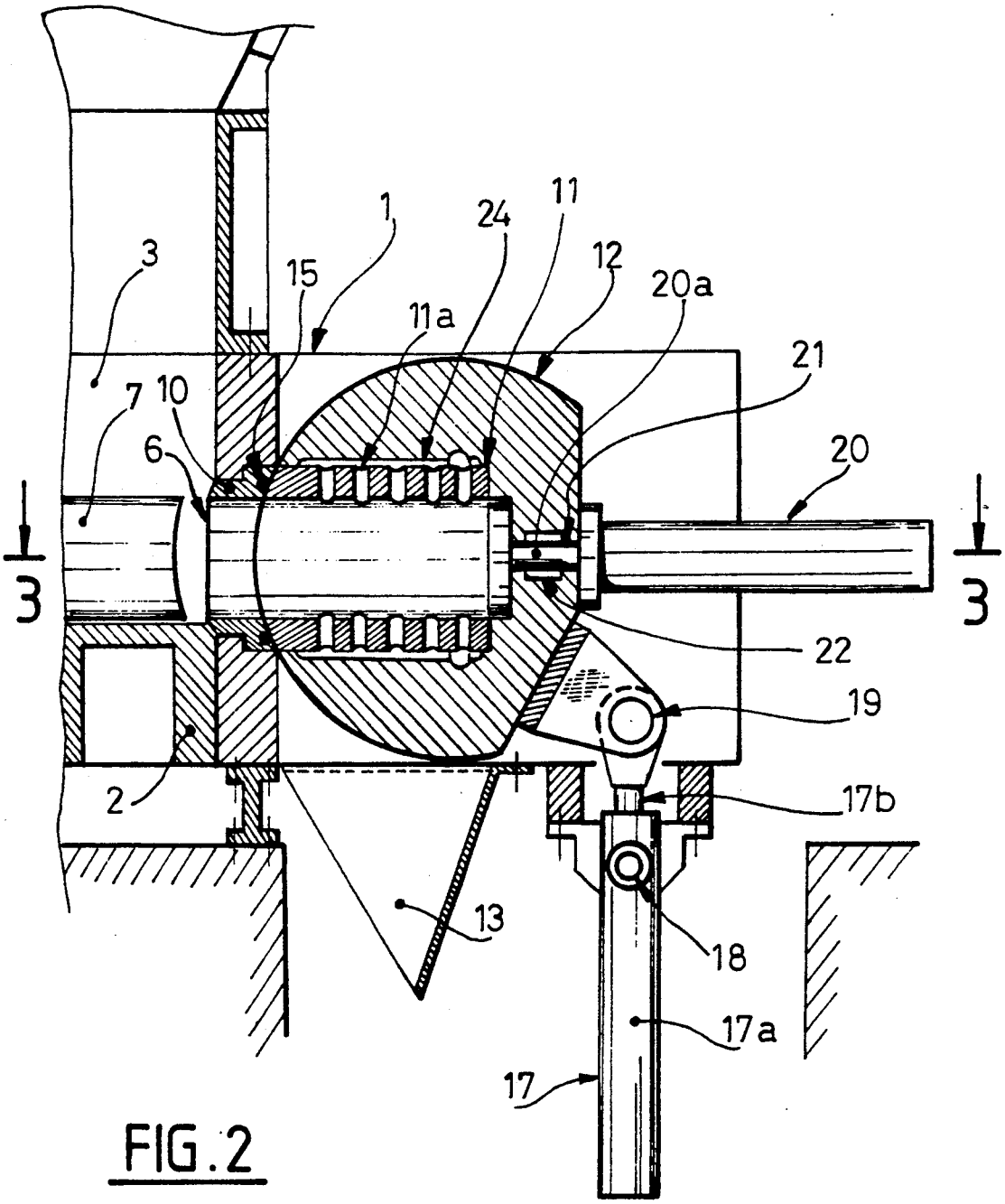
FIG. 2 is a sectional view on a larger scale of the die-holder slide and of the maneuvering means, in a position of pressing the waste.
Figure 3:
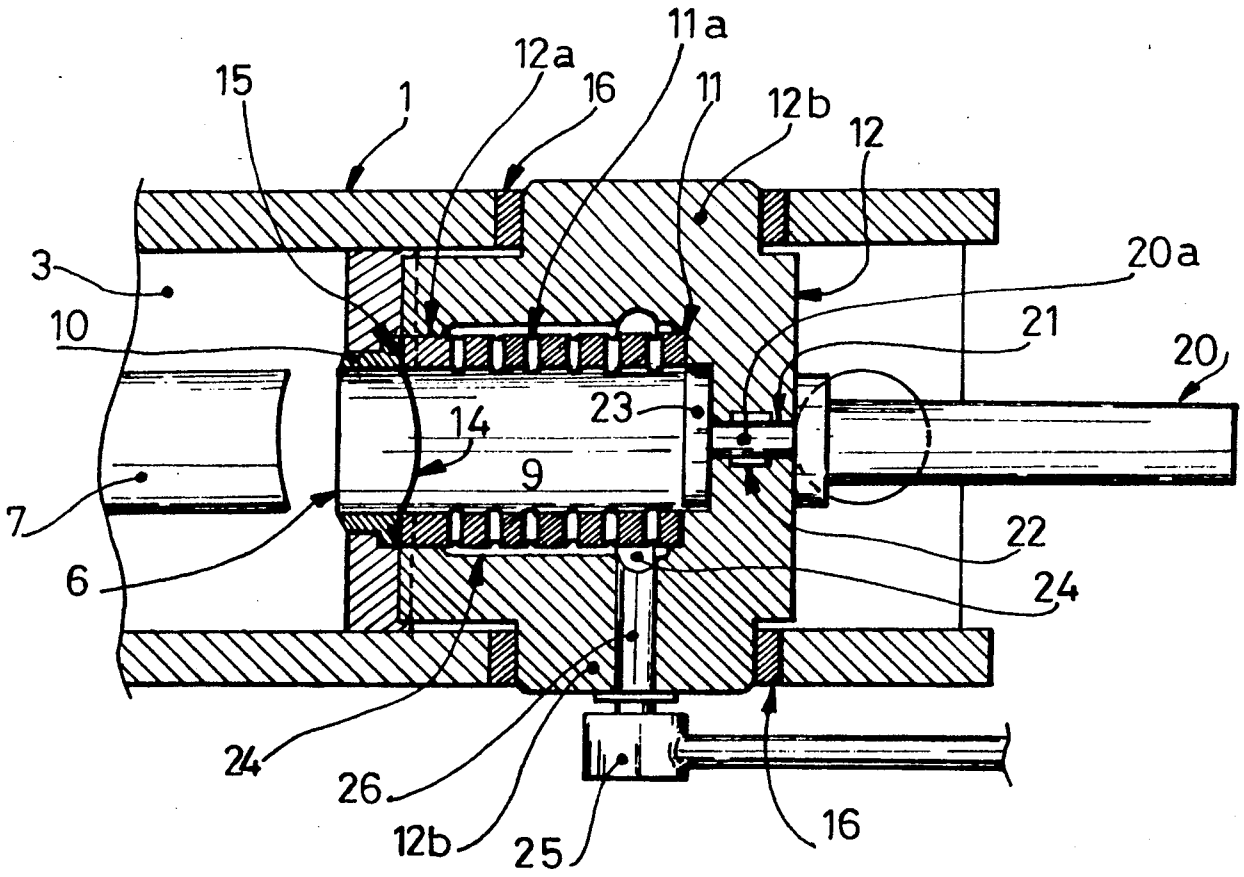
FIG. 3 is a sectional view along line 3—3 in FIG. 2.

As shown on a larger scale in FIGS. 2 and 3, the pressing chamber 9 is formed by a die 11 with a cross-section equal to that of the compression piston 7 and pierced with a multitude of small calibrated passages 11*a* for the discharge of the liquid phase at the time of pressing the waste in the chamber 9.

The die 11 is mounted in a blind bore 12*a* in a die-holder slide 12, movable angularly between a first position placing the pressing chamber 9 in communication with the feed zone 3, and a second position placing the pressing chamber 9 in communication with a hatch 13 for discharge of the solid phase after pressing of the waste.

The slide 12 comprises a single orifice 14 serving both as entry into the pressing chamber 9 for the waste to be pressed and as exit from the said chamber 9 of the solid phase of the compacted waste.

The end 11*b* of the die 11 in contact with the ring 10 has a form which complements the ring 10.

The face of the ring 10 in contact with the end of the die 11 is provided with a seal 15 ensuring leak-tightness between ring 10 and the die 11.

As shown in FIG. 3, the slide 12 is mounted in an articulated manner in the frame 1 of the press by means of two lateral and opposing shafts 12*b*, each accommodated in an adjustable bearing 16 integral with the frame.

The slide 12 is connected to means for controlling the displacement of the slide, which are formed by a ram 17 (FIG. 2) whose body 17*a* is mounted in an articulated manner about a shaft 18 on the frame 1 and the end of the rod 17*b* of which is connected to the slide 12 by a clevis-type articulation 19.

The slide 12 also comprises means for discharge of the solid phase and means for discharge of the liquid phase of the die 11.

The means for discharge of the solid phase of the waste from the pressing chamber 9 are formed by a low-pressure ram 20 (FIGS. 2 and 3) disposed coaxially with the pressing chamber and integral with the slide 12.

The rod 20*a* of the ram 20 slides in an emerging bore 21 axially traversing the back of the slide 12.

The central part of bore 21 comprises an annular decompression chamber 22 ensuring recovery of any leakages. The free end of the rod 20*a* carries a disc 23 forming the back of the pressing chamber 9 and with dimensions which complement the die 11.

The disc 23 bears on the back of the blind bore 12*a* of the slide 12 during pressing of waste in the pressing chamber 9, which makes it possible to take up the pressing stress directly on the slide 12, thus independently of the ram 20 controlling this disc.

The means for discharge of the liquid phase of the waste from the pressing chamber 9 are formed by at least one channel 24 at the periphery of the die 11 communicating both with the calibrated passages 11*a* of the die and with a collector 25 for recovery of the liquid phase via a conduit 26 traversing one of the shafts 12*b* of the slide 12.

The collector 25 is located outside the slide 12.

The operation of the press is as follows.

The heterogeneous waste to be treated is introduced into the hopper 4 and pushed in the feed zone 3, for example by a rammer.

At the start of the treatment cycle, the piston is in the clear position, as shown in FIG. 1, so as to permit the introduction of the waste into the feed zone 3.

The slide 12 is also in the position shown in FIG. 1, i.e., the die is in the axis of the compression piston 7 so that the pressing chamber 9 communicates with the feed zone 3 via the orifice 6.

The disc 23 bears in the back of the pressing chamber 9.

The piston 7 controlled by the ram 8 moves towards the pressing chamber 9, pushing the waste contained in the feed zone 3 towards the said chamber 9.

The piston 7, continuing its advance, pushes the waste into the pressing chamber 9 until a high pressure is obtained and it compresses the waste in the latter against the disc 23 bearing on the back of the blind bore 12*a* in the slide 12, which makes it possible to take up the pressing stress directly on the slide 12. During compression of the waste in the pressing chamber 9, the liquid phase is expressed from this raw waste and is discharged towards the collector 25 via the calibrated passages 11*a* and the conduit 26.

Pressing of the waste being completed, the compression piston 7 is brought back into its initial position by the ram 8.

Figure 4:
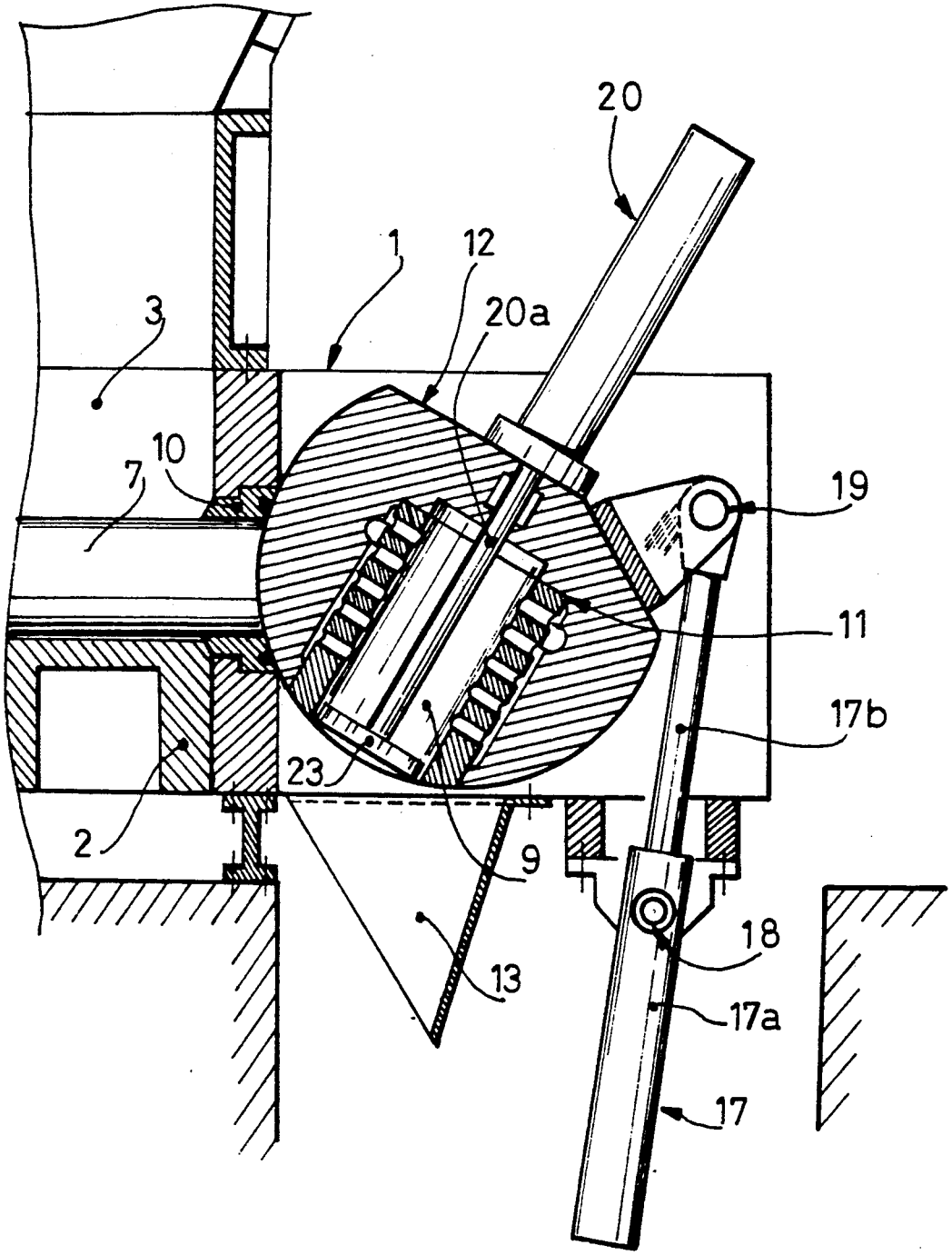
FIG. 4 is a sectional view of the die-holder slide in a position of discharge of the solid phase of the waste.

The control ram 17 is then actuated so that the slide 12 pivots about the axes 12*b*, in the bearings 16, thus placing the pressing chamber 9 in communication with the hatch 13 for discharge of the solid phase, as shown in FIG. 4.

The ram 20 is then pressurized so that the disc 23 moves axially in the die 11 and causes the extraction of the solid phase of the waste from the pressing chamber 9 towards the hatch 13.

When the solid parts have been discharged from pressing chamber 9, the disc 23 returns to its initial position through the action of the ram 20 and the control ram 17 ensures tilting of the slide 12 in the opposite direction in order to place the pressing chamber 9 in communication with the feed zone 3 for a fresh operating cycle similar to the preceding one.

This system has the advantage of directly using the back of the pressing chamber to take up the maximum stress of the press by means of a fixed element integral with the frame and, consequently, of dispensing with any movable member for closing off the back of this pressing chamber.

It also makes it possible to achieve leaktightness between the fixed part and the movable part of the press in a low-pressure zone and to limit the travel of the compression piston.

I claim:

1. Press for heterogeneous waste comprising a solid phase and a liquid phase, said press comprising (a) a frame (1) supporting a receptacle (2) forming a feed zone (3) receiving heterogeneous waste, said feed zone having an open top and first and second opposing lateral openings (5, 6);

(b) a compression piston (7) and means for moving said compression piston between said first opening (5) of said feed zone (3) and a position located downstream of said second opening (6) of said feed zone, said first and second openings having a cross-section substantially equal to a cross-section of said compression piston;

(c) a chamber (9) in which said waste is compressed by said compression piston in order to separate said solid phase and said liquid phase, said chamber being formed by a die (11) with a cross-section substantially equal to said cross-section of said compression piston (7) and comprising calibrated passages (11*a*) connecting said pressing chamber (9) to a collector (25) located below said pressing chamber for recovery of said liquid phase; and (d) a hatch (13) located below said pressing chamber for discharge of said solid phase;

(e) wherein said die (11) is mounted in a slide (12), connected to means for controlling angular displacement of said slide between a first position in which said pressing chamber (9) is in communication with said feed zone (3) and a second position in which said pressing chamber (9) is in communication with said hatch (13), said slide being associated with means for effecting discharge of said solid phase and means for effecting discharge of said liquid phase.

2. Press according to claim 1, wherein said slide (12) comprises a single orifice (14) for entry into said pressing chamber (9) of the waste to be pressed and for exit from said pressing chamber (9) of the solid phase of said pressed waste.

3. Press according to claim 1, wherein said slide (12) is mounted in an articulated manner on said frame (1) by means of two opposing lateral shafts (12*b*), each accommodated in a bearing (16) integral with said frame (1).

4. Press according to claim 1, wherein said means for controlling angular displacement of said slide are formed by a ram (17) having a body (17*a*) mounted in an articulated manner on said frame (1) of said press and having a rod (17*b*) which has an end connected to said slide (12) by a clevis-type articulation (19).

5. Press according to claim 1, wherein said means for discharge of the solid phase are constituted by a ram (20) arranged coaxially with said pressing chamber (9) and integral with said slide (12).

6. Press according to claim 5, wherein said ram (20) has a rod (20*a*) which traverses said slide (12) and which comprises a free end with a disc (23) forming a back of said pressing chamber (9) and having dimensions which complement said die (11).

7. Press according to claim 1, wherein said means for discharge of the liquid phase are constituted by at least one channel (24) located at a periphery of said die (11) and communicating with said calibrated passages (11*a*) of said die (11) and said collector.

* * * * *

UNITED STATES PATENT AND TRADEMARK OFFICE

CERTIFICATE OF CORRECTION

PATENT NO. : 5,251,552

DATED : October 12, 1993

INVENTOR(S) : Jacques Gourdol

It is certified that error appears in the above-indentified patent and that said Letters Patent is hereby corrected as shown below:

On the title page, insert the following information:

[73] Assignee: Neyrpic Framatome Mecanique, Courbevoie, France.

Signed and Sealed this

Sixth Day of December, 1994

*Attest:*

*Attesting Officer*

BRUCE LEHMAN

*Commissioner of Patents and Trademarks*